US012692805B2

(12) United States Patent
Lin et al.

(10) Patent No.: US 12,692,805 B2
(45) Date of Patent: Jul. 28, 2026

(54) LUBRICATING OIL FILTER BASE ASSEMBLY AND LUBRICATING OIL FILTER RADIATOR ASSEMBLY

(71) Applicant: WENZHOU DEXIN AUTO PARTS CO., LTD., Wenzhou (CN)

(72) Inventors: Xiaofu Lin, Wenzhou (CN); Wanyi Lin, Wenzhou (CN); Feng Cai, Wenzhou (CN)

(73) Assignee: WENZHOU DEXIN AUTO PARTS CO., LTD., Wenzhou (CN)

( * ) Notice: Subject to any disclaimer, the term of this patent is extended or adjusted under 35 U.S.C. 154(b) by 0 days.

(21) Appl. No.: 19/026,428

(22) Filed: Jan. 17, 2025

(65) Prior Publication Data

US 2026/0185469 A1 Jul. 2, 2026

(30) Foreign Application Priority Data

Dec. 31, 2024 (CN) ..... 202423300854.X

(51) Int. Cl.
*F01M 11/03* (2006.01)

(52) U.S. Cl.
CPC ..... *F01M 11/03* (2013.01); *F01M 2011/033* (2013.01)

(58) Field of Classification Search
CPC ..... F01M 11/02; F01M 11/03; F01M 5/002; F01M 2011/031; F01M 2011/033; F01P 11/08; F28F 2280/06; F28D 2021/0089
See application file for complete search history.

(56) References Cited

U.S. PATENT DOCUMENTS

| | | | | |
|---|---|---|---|---|
| 7,261,080 | B2 * | 8/2007 | Chonan | F01M 11/03 123/196 AB |
| 7,353,794 | B2 * | 4/2008 | Gruner | B01D 35/18 123/196 AB |
| 8,186,328 | B2 * | 5/2012 | Kiemlen | F01M 5/002 123/41.31 |
| 8,887,688 | B1 * | 11/2014 | Neal | F01M 1/10 123/196 R |
| 11,339,692 | B2 * | 5/2022 | Girondi | F28D 9/005 |
| 11,821,346 | B2 * | 11/2023 | Chen | B01D 35/185 |
| 12,059,642 | B1 * | 8/2024 | Lin | B01D 35/18 |
| 2008/0006229 | A1 * | 1/2008 | Wilmink | F01P 11/06 123/196 AB |
| 2015/0218980 | A1 * | 8/2015 | Bonde | F01M 11/03 184/6.5 |

* cited by examiner

*Primary Examiner* — Grant Moubry
*Assistant Examiner* — James G Moubry
(74) *Attorney, Agent, or Firm* — Bayramoglu Law Offices LLC

(57) ABSTRACT

A lubricating oil filter base assembly and lubricating oil filter radiator assembly are provided. The lubricating oil filter base assembly includes a base and a radiator, where the radiator is assembled on an upper surface of the base; the base is provided with an oil passage; the oil passage is communicated with an inner chamber of a filter housing and an oil outlet; the upper surface of the base is provided with a cooling outlet and a cooling inlet; the cooling outlet is communicated with the oil passage, and the cooling inlet is communicated with the oil outlet; the oil passage is provided with a tortuous section; the tortuous section is provided between the cooling outlet and an outlet of the oil passage; and lubricating oil flows through a tortuous flow path in the tortuous section, which reduces the flow velocity of the lubricating oil.

20 Claims, 6 Drawing Sheets

LUBRICATING OIL FILTER BASE ASSEMBLY AND LUBRICATING OIL FILTER RADIATOR ASSEMBLY

CROSS REFERENCE TO THE RELATED APPLICATIONS

This application is based upon and claims priority to Chinese Patent Application No. 202423300854.X, filed on Dec. 31, 2024, the entire contents of which are incorporated herein by reference.

TECHNICAL FIELD

The present disclosure relates to the field of automobile lubrication systems, and in particular to a lubricating oil filter base assembly and lubricating oil filter radiator assembly.

BACKGROUND

The automobile lubricating oil filter, located in the engine lubrication system, is configured to filter out harmful impurities in the lubricating oil from the oil pan, allowing the filtered lubricating oil to be supplied to components such as cranks for lubrication, cooling, and cleaning, thereby extending the lifespan of these components.

In order to solve the problems of poor cooling effect and difficult processing of existing lubricating oil filter bases, CN220522650U discloses an automobile lubricating oil filter base assembly and automobile lubricating oil filter radiator assembly. This disclosure can improve the cooling effect, reduce the processing difficulty, and enhance the molding effect of the product.

Lubricating oil will generate heat during engine operation. If the temperature of the lubricating oil is too high, it will affect lubrication performance and prevent the formation of a stable oil film, thereby exacerbating engine wear. Therefore, there is a great demand for lubricating oil cooling, and improving the cooling performance of the lubricating oil filter radiator assembly is still a research and development direction.

SUMMARY

In view of the technical problems mentioned in the background section, a technical problem to be solved by the present disclosure is to provide a lubricating oil filter base assembly and lubricating oil filter radiator assembly with better cooling effect.

To solve the above technical problem, the present disclosure adopts the following technical solutions. A lubricating oil filter base assembly includes a slender base, where two ends of the base serve as a first end and a second end, respectively; the first end of the base is integrally provided with a filter housing; and the base includes an upper surface assembled with a radiator and a lower surface provided with an oil outlet;

the base is provided with an oil passage; the oil passage is longitudinally provided and communicated with an inner chamber of the filter housing and the oil outlet; the upper surface of the base is provided with a cooling outlet and a cooling inlet; and the cooling outlet is communicated with the oil passage, and the cooling inlet is communicated with the oil outlet; and the oil passage is provided with a tortuous section; the tortuous section is provided between the cooling outlet and an outlet of the oil passage; and lubricating oil flows through a tortuous flow path in the tortuous section.

In the present disclosure, the oil passage is provided with the tortuous section, and the lubricating oil flows in the tortuous flow path in the tortuous section, reducing the flow velocity of the lubricating oil and making more lubricating oil enter the radiator from the cooling outlet. More lubricating oil is cooled by the radiator to enter the base through the cooling inlet, and is output from the oil outlet on the lower surface of the base. The output lubricating oil is mostly cooled, which overall improves the cooling effect of the lubricating oil and achieves relatively lower temperature of the output lubricating oil.

Preferably, the tortuous section of the oil passage is provided with baffles; the baffles are transversely arranged in the oil passage; and the baffles each have a width smaller than a width of the oil passage or/and a height smaller than a height of the oil passage. The setting of the baffles enables the tortuous shape of the flow path of the lubricating oil in the tortuous section. In this way, even if the tortuous section is in a straight passage, the setting of the baffles makes the flow path tortuous.

Preferably, the tortuous section of the oil passage is generally a straight passage, reducing the difficulty of processing.

There are multiple baffles; and each two adjacent baffles are misaligned with each other. Thus, the flow path of the lubricating oil is tortuous, thereby reducing the flow velocity of the lubricating oil in the tortuous section.

Preferably, the baffles each include one side end located on one side wall of the oil passage and the other side end forming a flow gap with the other side wall of the oil passage; and the multiple baffles are alternately arranged on the two side walls of the oil passage.

Preferably, the oil passage extends towards the first end of the base to form a first core opening; the tortuous section extends towards the upper surface of the base to form a second core opening; and the second core opening is sealed with a bottom surface of the radiator. The setting of the second core opening greatly reduces the difficulty of processing the oil passage, and can process tortuous sections with different shapes. Meanwhile, the lubricating oil in the oil passage can directly contact the bottom surface of the radiator in the tortuous section, further improving the cooling effect of the lubricating oil.

Preferably, the second core opening has a width greater than widths of an inlet and the outlet of the oil passage; and the second core opening expands transversely to approach two side walls of the base. The design increases the capacity of the tortuous section for holding the lubricating oil and the contact area between the lubricating oil and the radiator, thereby further improving the cooling effect.

Preferably, the oil outlet is located close to the second end of the base; the oil outlet extends upwards to form an oil hole; and the oil hole is communicated with the outlet of the oil passage; and the cooling inlet extends into the base and is communicated with the oil hole.

Preferably, the second end of the base is provided with a mounting hole; and the mounting hole extends into the base and is communicated with the oil hole;

the base is fabricated by metal casting; and the mounting hole is riveted with a connector including an internal thread; and the connector is fabricated by metal casting; and a sealing ring is provided between the connector and the mounting hole.

The connector is configured for threaded connection of a sensor, facilitating the maintenance of the sensor. The metal cast connector has a long service life and is not easily aged or damaged. The connector is riveted inside the mounting hole, with excellent sealing effect, and can be disassembled and replaced. Therefore, even if the connector is damaged or there is a lubricating oil leakage, the connector can be repaired replacing.

Preferably, the mounting hole is provided with a protrusion or groove that matches the connector; the protrusion or the groove is configured to limit and position the mounting hole and the connector, so as to prevent the connector from rotating in the mounting hole; and the mounting hole includes a pressure sensor mounting hole and a temperature sensor mounting hole.

Preferably, the base is fabricated by metal casting; and a metal sealing plug is riveted in the first core opening.

A lubricating oil filter radiator assembly includes a lubricating oil filter base assembly and a radiator, where the lubricating oil filter base assembly includes a slender base, where two ends of the base serve as a first end and a second end, respectively; the first end of the base is integrally provided with a filter housing; and the base includes an upper surface assembled with a radiator and a lower surface provided with an oil outlet;

the base is provided with an oil passage; the oil passage is longitudinally provided and communicated with an inner chamber of the filter housing and the oil outlet; the upper surface of the base is provided with a cooling outlet and a cooling inlet; and the cooling outlet is communicated with the oil passage, and the cooling inlet is communicated with the oil outlet;

the oil passage is provided with a tortuous section; the tortuous section is provided between the cooling outlet and an outlet of the oil passage; and the lubricating oil flows through a tortuous flow path in the tortuous section; and the radiator is assembled on the upper surface of the base.

REFERENCE NUMERALS

Figure 1:
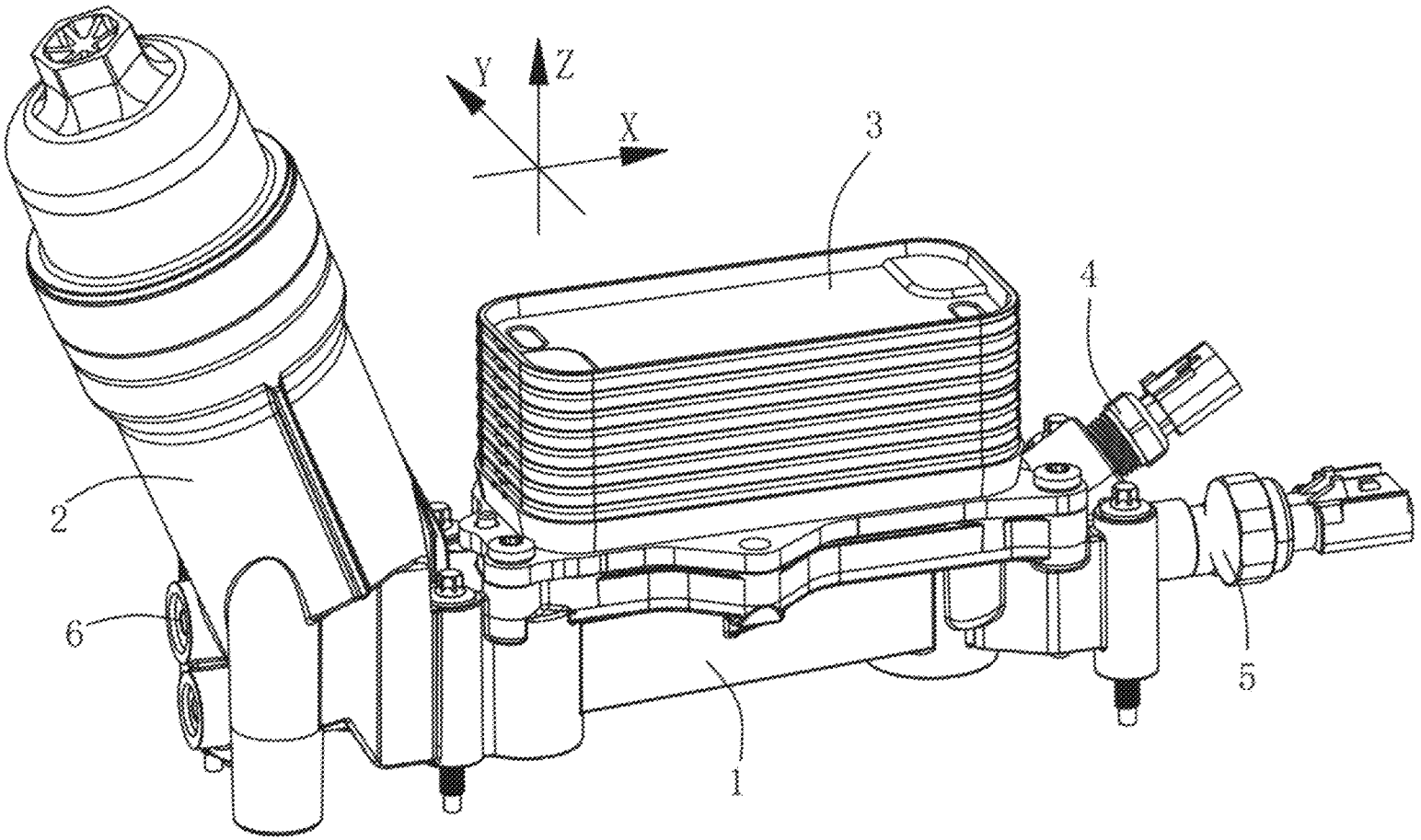
FIG. 1 is a three-dimensional diagram of a lubricating oil filter radiator assembly.
Figure 2:
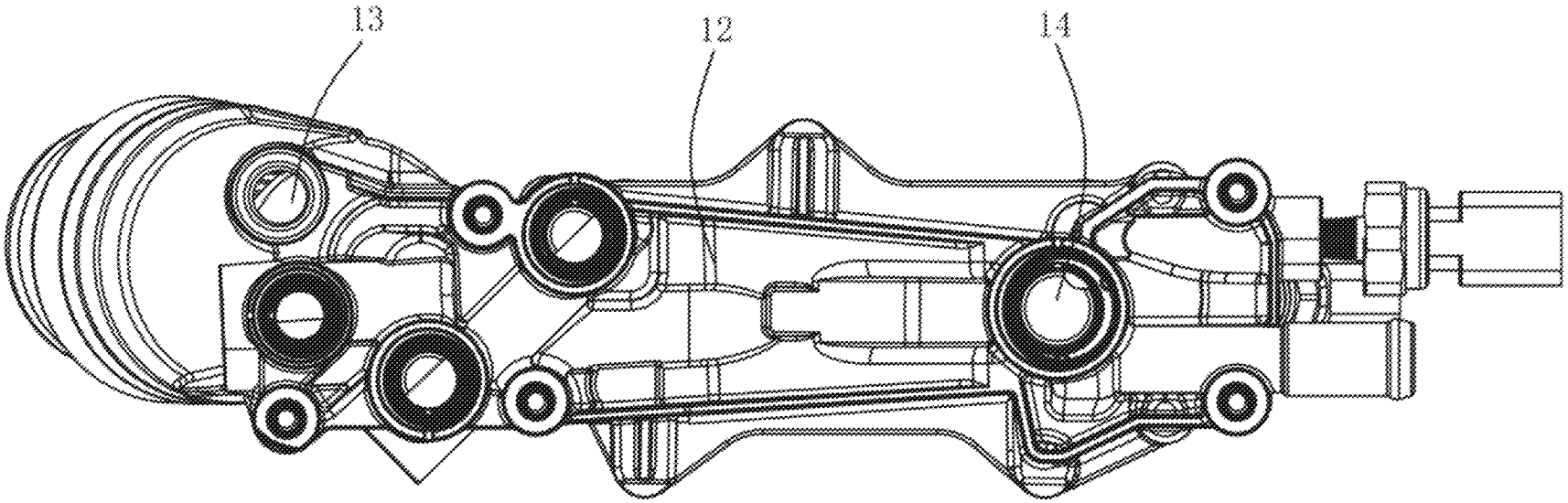
FIG. 2 is a bottom view of the lubricating oil filter radiator assembly.
Figure 3:
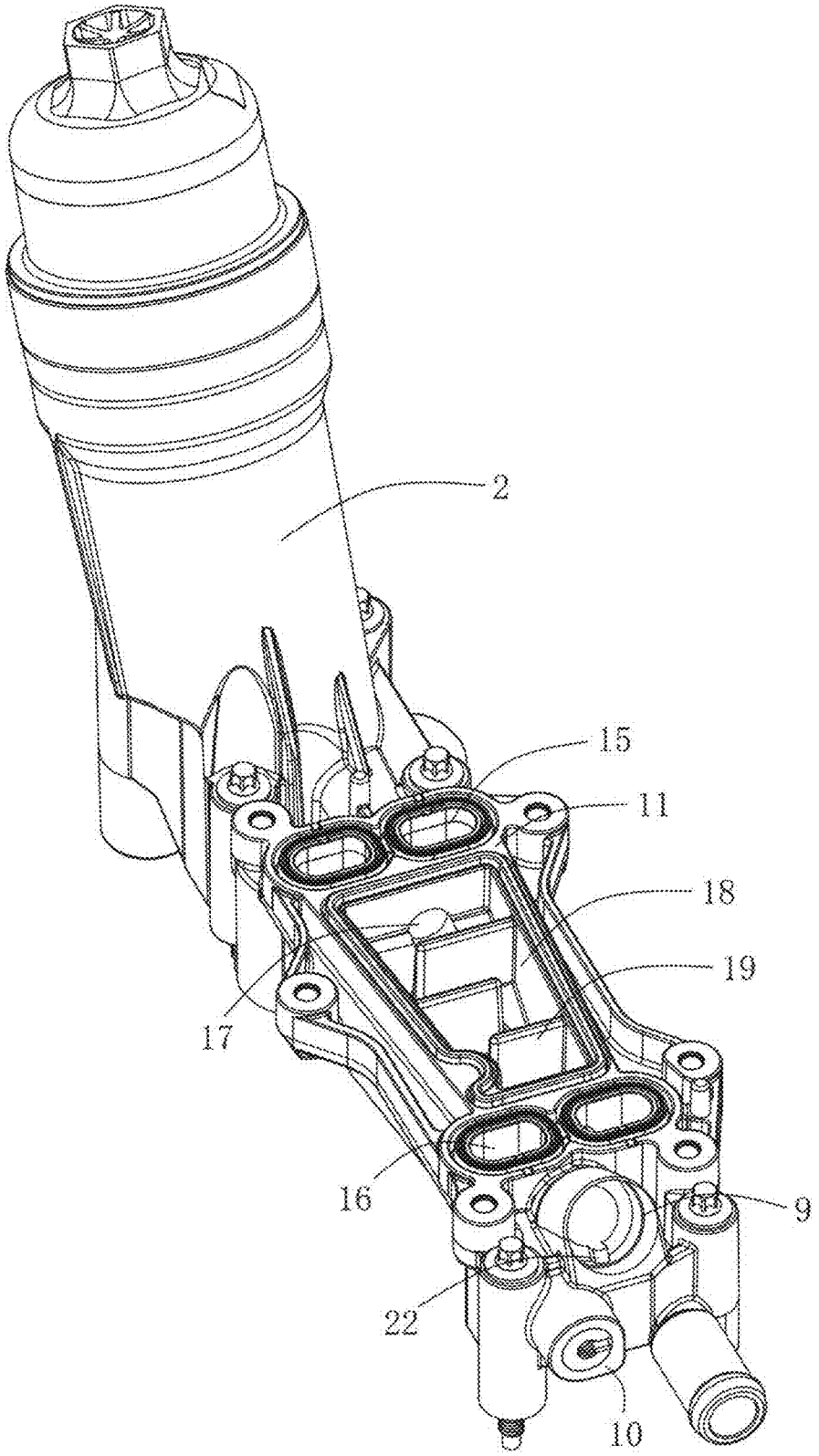
FIG. 3 is a schematic diagram of a lubricating oil filter base assembly.

1. base; 2. filter housing; 3. radiator; 4. temperature sensor; 5. pressure sensor; 6. first core opening; 7. second core opening; 8. oil passage; 9. mounting hole; 10. connector; 11. upper surface; 12. lower surface; 13. lubricating oil inlet; 14. oil outlet; 15. cooling outlet; 16. cooling inlet; 17. first section; 18. tortuous section; 19. baffle; 20. sealing ring; 21. oil hole; 22. protrusion; 23. groove; 24. flow path.

DETAILED DESCRIPTION OF THE EMBODIMENTS

According to the drawings, the relevant details and working principles of the implementations and embodiments of the present disclosure are described as follows. In the figures, an X-axis indicates a longitudinal direction, a Y-axis indicates a transverse direction, and a Z-axis indicates a vertical direction.

A lubricating oil filter radiator assembly includes a lubricating oil filter base assembly and radiator 3. The lubricating oil filter base assembly includes slender base 1, which is longer in length and narrower in width. Two ends of the base 1 serve as a first end and a second end, respectively. The first end of the base is integrally provided with filter housing 2. The filter housing is provided with lubricating oil inlet 13. The base includes upper surface 11 assembled with the radiator 3 and lower surface 12 provided with oil outlet 14. The radiator 3 is assembled on the upper surface 11 of the base. The oil outlet 14 on the lower surface of the base is communicated with an oil circuit of an engine. The lubricating oil inlet 13 is also located on the lower surface of the base. The base is provided with oil passage 8. The oil passage is longitudinally provided and communicated with an inner chamber of the filter housing 2. The upper surface 11 of the base is provided with cooling outlet 15 and cooling inlet 16. The cooling outlet is communicated with the oil passage 8, and the cooling inlet is communicated with the oil outlet 14. The oil passage 8 is provided with tortuous section 18, and the lubricating oil flows through tortuous flow path 24 in the tortuous section, reducing the flow velocity of the lubricating oil in the tortuous section and allowing more lubricating oil to enter the radiator 3 from the cooling outlet 15. Preferably, the tortuous section 18 is provided between the cooling outlet 15 and an outlet of the oil passage. The lubricating oil is filtered through a filter and directly enters the radiator 3 through the cooling outlet 15, without going through the tortuous section 18, and without reducing the flow velocity of the lubricating oil entering the radiator. More lubricating oil is cooled by the radiator to enter the base through the cooling inlet 16, and is output from the oil outlet 14 on the lower surface of the base. The output lubricating oil is mostly cooled, which overall improves the cooling effect of the lubricating oil and achieves relatively lower temperature of the output lubricating oil.

Figure 4:
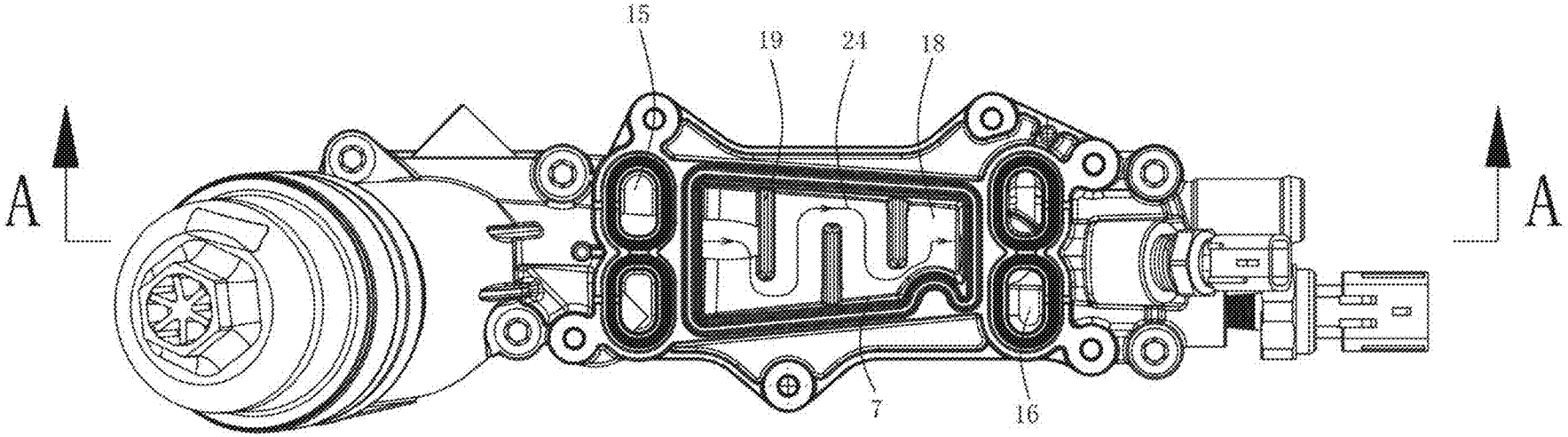
FIG. 4 is a top view of the lubricating oil filter base assembly.
Figure 5:
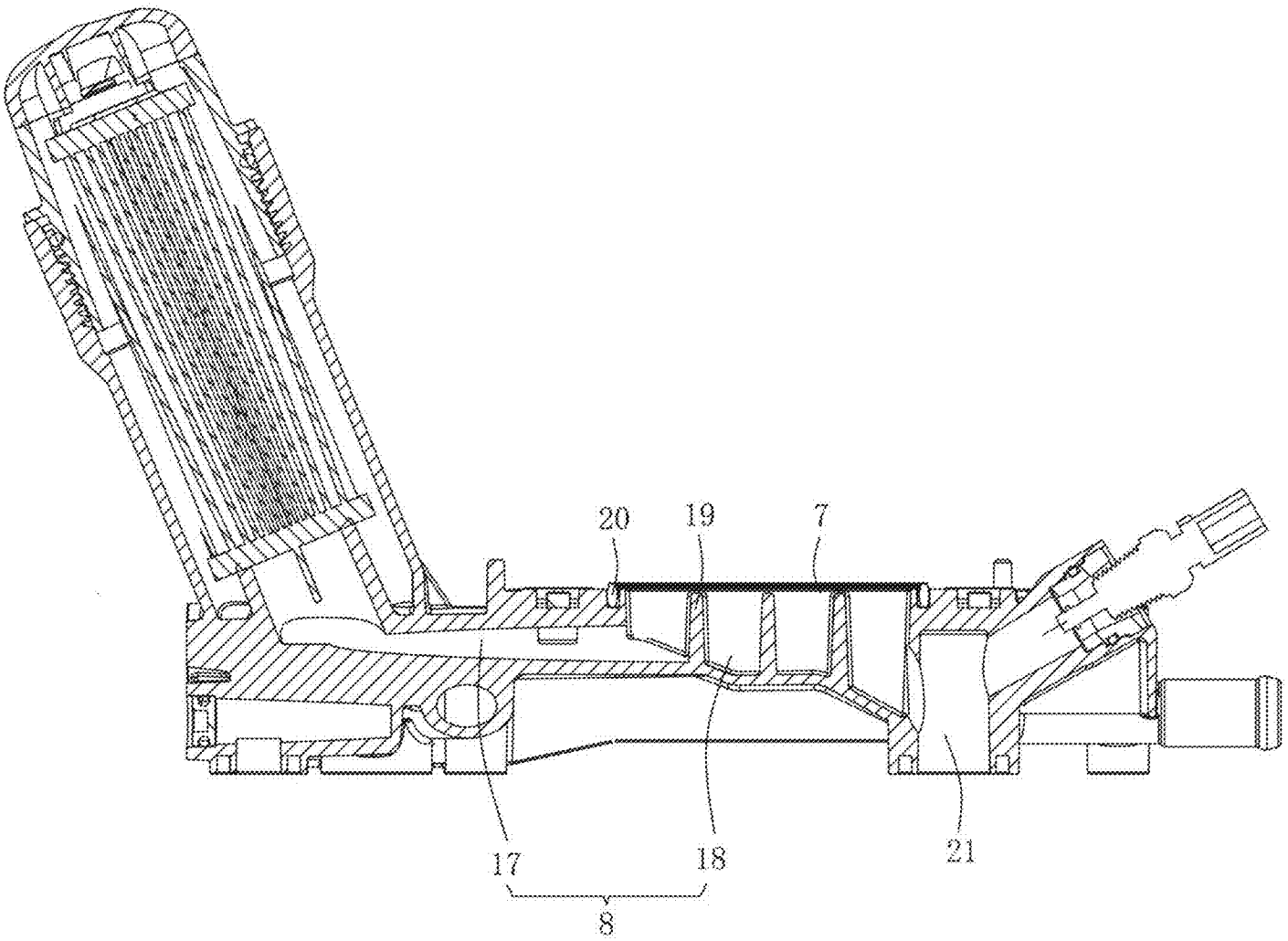
FIG. 5 is a section view taken along line A-A shown in FIG. 4.
Figure 6:
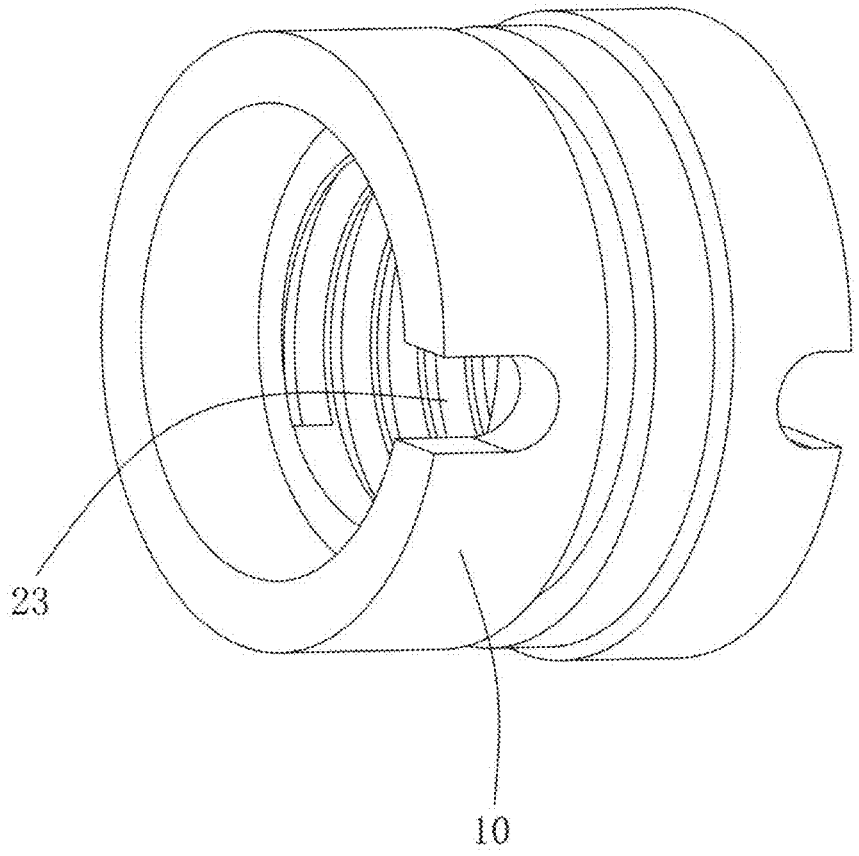
FIG. 6 is a schematic diagram of a connector according to the present disclosure.

The tortuous section 18 of the oil passage 8 is designed in a tortuous curve shape, making the flow path 24 of the lubricating oil flowing through the tortuous section tortuous, but this increases the difficulty of processing the oil passage. As shown in FIG. 4, the tortuous section 18 of the oil passage is generally a straight passage. The tortuous section 18 of the oil passage is provided with baffles 19. The baffles 19 are transversely arranged in the oil passage. The baffles each have a width smaller than a width of the oil passage or/and a height smaller than a height of the oil passage. The setting of the baffles 19 enables the tortuous shape of the flow path 24 of the lubricating oil in the tortuous section. In this way, even if the tortuous section is in a straight passage, the setting of the baffles 19 makes the flow path 24 tortuous. When the oil passage is a straight passage, there is more space for use and it is also easier to process. There are multiple baffles 19; and each two adjacent baffles are misaligned with each other. For example, a first baffle is connected to a left side wall of the oil passage, and there is a flow gap between the first baffle and a right side wall of the oil passage. A second baffle is connected to the right side wall of the oil passage, and there is a flow gap between the second baffle and the left side wall of the oil passage. A third baffle is connected to the left side wall of the oil passage, and there is a flow gap between the third baffle and the right side wall of the oil passage. Through the misalignment setting, the flow path 24 of the lubricating oil in the tortuous section is tortuous, thereby reducing the flow velocity of the lubricating oil in the tortuous section. Alternatively, a vertical misalignment design can be adopted. That is, the first baffle is connected to a bottom surface of the oil passage, and the second baffle is connected to a top surface of the oil passage, allowing the lubricating oil to bypass from top to bottom and form a tortuous shape. In the figure, the baffle includes one side end located on one side wall of the oil passage and the other side end forming a flow gap with the other side wall of the oil passage. The multiple baffles are alternately arranged on the two side walls of the oil passage, forming the first implementation method mentioned above.

The oil passage extends towards the first end of the base 1 to form first core opening 6. The tortuous section 18 extends towards the upper surface 11 of the base to form second core opening 7. The second core opening 7 is sealed with a bottom surface of the radiator 3. The first core opening 6 and the second core opening 7 are used for removing cores for casting processing. The core exits from the first core opening and the second core openings to form the oil passage 8 on the base. The oil outlet 14 on the lower surface 12 of the base is located close to the second end of the base 1. The oil outlet 14 extends upwards to form oil hole 21. The oil hole 21 is communicated with the outlet of the oil passage 8. The cooling inlet 16 extends into the base 1 and is communicated with the oil hole 21. The radiator 3 is assembled on the upper surface 11 of the base. The lubricating oil in the oil passage 8 is communicated with the radiator 3 through the cooling outlet 15 and the cooling inlet 16. The lubricating oil is cooled by the radiator 3 and output from the oil outlet 14, reducing the overall oil temperature. The bottom surface of the radiator 3 is connected to the upper surface 11 of the base by a screw, and sealing ring 20 is provided between the bottom surface of the radiator and the upper surface of the base to ensure the sealing effect there-between. The oil passage is divided into two sections, and there are two cores to be removed during casting processing, which are matched with first section 17 and a second section of the oil passage 8, respectively. The second section is the tortuous section 18, and the first section 17 runs from the tortuous section to the first end of the base. The setting of the second core opening 7 greatly reduces the difficulty of processing the oil passage 8, and can process tortuous sections 18 with different shapes. Meanwhile, the lubricating oil in the oil passage 8 can directly contact the bottom surface of the radiator 3 in the tortuous section 18, further improving the cooling effect of the lubricating oil. The second core opening 7 has a width greater than those of an inlet and the outlet of the oil passage 8. The second core opening 7 expands transversely to approach two side walls of the base, increasing the capacity of the tortuous section 18 for holding the lubricating oil and the contact area between the lubricating oil and the radiator 3, thereby further improving the cooling effect.

The base 1 is fabricated by metal casting, which has better cooling effect and longer service life. The second end of the base is provided with mounting hole 9. The mounting hole 9 extends into the base and is communicated with the oil hole 21. The mounting hole 9 is riveted with connector 10 including an internal thread. The connector is configured for threaded connection of a sensor. The mounting hole includes a pressure sensor mounting hole and a temperature sensor mounting hole. Pressure sensor 5 and temperature sensor 4 are mounted through threads, making it easier to maintain the sensors.

The connector 10 is fabricated by metal casting; and a sealing ring is provided between the connector and the mounting hole 9. The metal cast connector 10 has a long service life and is not easily aged or damaged. The connector is riveted inside the mounting hole, with excellent sealing effect, and can be disassembled and replaced. Therefore, even if there is a lubricating oil leakage at the mounting hole, it can be repaired by replacing the connector. The mounting hole is provided with a protrusion or groove that matches the connector 10. In the figure, the mounting hole is provided with protrusion 22, and the connector is provided with matching groove 23. During riveting, the groove 23 of the connector is aligned with the protrusion 22 of the mounting hole, and the connector 10 is riveted into the mounting hole 9. The riveted connector will not rotate in a circumferential direction relative to the mounting hole. The base is provided with the core openings, such as the first core opening 6, due to casting requirements. These core openings can also be sealed and clogged by riveting metal sealing plugs into them.

The working principle of the preferred embodiment is further explained in conjunction with the drawings. The lubricating oil enters the filter housing 2 through the lubricating oil inlet 13 and enters the oil passage 8 after being filtered by the filter. A part of the lubricating oil enters the radiator 3 through the oil passage from the cooling outlet 15, enters the oil hole 21 of the base through the cooling inlet 16 after being cooled by the radiator 3, and finally is discharged from the oil outlet 14. A part of the lubricating oil passes through the tortuous section 18 of the oil passage. Due to the obstruction of the baffles, this part of the lubricating oil passes through the flow gaps between the baffles and the side walls of the oil passage. It sequentially bypasses the multiple baffles along the tortuous flow path as shown in FIG. 4. Finally, this part of the lubricating oil enters the oil hole 21 and is discharged from the oil outlet 14. Due to the obstruction of the lubricating oil in the tortuous section and the decrease in the flow velocity of the lubricating oil, more lubricating oil enters the radiator 3 from the cooling outlet 15, and more lubricating oil is output from the oil outlet 14 after being cooled by the radiator. Compared with the prior art, the proportion of the lubricating oil output from the oil outlet after being cooled by the radiator is increased, resulting in a relatively lower temperature of the output lubricating oil and a better cooling effect. In addition, the lubricating oil in the tortuous section 1 comes into extensive contact with the bottom surface of the radiator, allowing this part of the lubricating oil to be cooled and reduce its temperature.

What is claimed is:

1. A lubricating oil filter base assembly, comprising a base, wherein two ends of the base serve as a first end and a second end, respectively; the first end of the base is integrally provided with a filter housing; and the base comprises an upper surface assembled with a radiator and a lower surface provided with an oil outlet;

the base is provided with an oil passage; the oil passage is longitudinally provided and communicated with an inner chamber of the filter housing and the oil outlet; the upper surface of the base is provided with a cooling outlet and a cooling inlet; and the cooling outlet is communicated with the oil passage, and the cooling inlet is communicated with the oil outlet; and the oil passage is provided with a tortuous section; the tortuous section is provided between the cooling outlet and an outlet of the oil passage; and lubricating oil flows through a tortuous flow path in the tortuous section.

2. The lubricating oil filter base assembly according to claim 1, wherein the tortuous section of the oil passage is provided with a baffle; the baffle is transversely arranged in the oil passage; and the baffle has a width smaller than a width of the oil passage or/and a height smaller than a height of the oil passage.

3. The lubricating oil filter base assembly according to claim 2, wherein the oil passage extends towards the first end of the base to form a first core opening; the tortuous section extends towards the upper surface of the base to form a second core opening; and the second core opening is sealed with a bottom surface of the radiator.

4. The lubricating oil filter base assembly according to claim 3, wherein the second core opening has a width greater than widths of an inlet and the outlet of the oil passage; and the second core opening expands transversely to approach two side walls of the base.

5. The lubricating oil filter base assembly according to claim 2, wherein the oil outlet is located close to the second end of the base; the oil outlet extends upwards to form an oil hole; and the oil hole is communicated with the outlet of the oil passage; and the cooling inlet extends into the base and is communicated with the oil hole.

6. The lubricating oil filter base assembly according to claim 2, wherein the tortuous section of the oil passage is generally a straight passage; and the baffle is provided in a plurality; and each two adjacent baffles are misaligned with each other.

7. The lubricating oil filter base assembly according to claim 6, wherein the oil passage extends towards the first end of the base to form a first core opening; the tortuous section extends towards the upper surface of the base to form a second core opening; and the second core opening is sealed with a bottom surface of the radiator.

8. The lubricating oil filter base assembly according to claim 6, wherein the oil outlet is located close to the second end of the base; the oil outlet extends upwards to form an oil hole; and the oil hole is communicated with the outlet of the oil passage; and the cooling inlet extends into the base and is communicated with the oil hole.

9. The lubricating oil filter base assembly according to claim 6, wherein the baffle comprises a first side end located on a first side wall of the oil passage and a second side end forming a flow gap with a second side wall of the oil passage; and the plurality of baffles are alternately arranged on the first side wall and the second side wall of the oil passage.

10. The lubricating oil filter base assembly according to claim 9, wherein the oil passage extends towards the first end of the base to form a first core opening; the tortuous section extends towards the upper surface of the base to form a second core opening; and the second core opening is sealed with a bottom surface of the radiator.

11. The lubricating oil filter base assembly according to claim 9, wherein the oil outlet is located close to the second end of the base; the oil outlet extends upwards to form an oil hole; and the oil hole is communicated with the outlet of the oil passage; and the cooling inlet extends into the base and is communicated with the oil hole.

12. The lubricating oil filter base assembly according to claim 1, wherein the oil passage extends towards the first end of the base to form a first core opening; the tortuous section extends towards the upper surface of the base to form a second core opening; and the second core opening is sealed with a bottom surface of the radiator.

13. The lubricating oil filter base assembly according to claim 12, wherein the second core opening has a width greater than widths of an inlet and the outlet of the oil passage; and the second core opening expands transversely to approach two side walls of the base.

14. The lubricating oil filter base assembly according to claim 1, wherein the oil outlet is located close to the second end of the base; the oil outlet extends upwards to form an oil hole; and the oil hole is communicated with the outlet of the oil passage; and the cooling inlet extends into the base and is communicated with the oil hole.

15. The lubricating oil filter base assembly according to claim 14, wherein the second end of the base is provided with a mounting hole; and the mounting hole extends into the base and is communicated with the oil hole;

the base is fabricated by metal casting; and the mounting hole is riveted with a connector comprising an internal thread; and the connector is fabricated by metal casting; and a sealing ring is provided between the connector and the mounting hole.

16. The lubricating oil filter base assembly according to claim 15, wherein the mounting hole is provided with a protrusion or groove matching with the connector; and the mounting hole comprises a pressure sensor mounting hole and a temperature sensor mounting hole.

17. A lubricating oil filter radiator assembly, comprising a lubricating oil filter base assembly and a radiator, wherein the lubricating oil filter base assembly is the lubricating oil filter base assembly according to claim 1; and the radiator is assembled on the upper surface of the base.

18. The lubricating oil filter radiator assembly according to claim 17, wherein in the lubricating oil filter base assembly, the tortuous section of the oil passage is provided with a baffle; the baffle is transversely arranged in the oil passage; and the baffle has a width smaller than a width of the oil passage or/and a height smaller than a height of the oil passage.

19. The lubricating oil filter radiator assembly according to claim 18, wherein in the lubricating oil filter base assembly, the tortuous section of the oil passage is generally a straight passage; and the baffle is provided in a plurality; and each two adjacent baffles are misaligned with each other.

20. The lubricating oil filter radiator assembly according to claim 19, wherein in the lubricating oil filter base assembly, the baffle comprises a first side end located on a first side wall of the oil passage and a second side end forming a flow gap with a second side wall of the oil passage; and the plurality of baffles are alternately arranged on the first side wall and the second side wall of the oil passage.

* * * * *